US006513008B2

(12) United States Patent
Pearson et al.

(10) Patent No.: US 6,513,008 B2
(45) Date of Patent: Jan. 28, 2003

(54) METHOD AND TOOL FOR CUSTOMIZATION OF SPEECH SYNTHESIZER DATABASES USING HIERARCHICAL GENERALIZED SPEECH TEMPLATES

(75) Inventors: Steve Pearson, Santa Barbara, CA (US); Peter Veprek, Santa Barbara, CA (US); Jean-Claude Junqua, Santa Barbara, CA (US)

(73) Assignee: Matsushita Electric Industrial Co., Ltd., Osaka (JP)

( * ) Notice: Subject to any disclaimer, the term of this patent is extended or adjusted under 35 U.S.C. 154(b) by 2 days.

(21) Appl. No.: 09/808,132

(22) Filed: Mar. 15, 2001

(65) Prior Publication Data

US 2002/0133348 A1 Sep. 19, 2002

(51) Int. Cl.[7] ..... G10L 13/06
(52) U.S. Cl. ..... 704/260; 704/268
(58) Field of Search ..... 704/260, 258, 704/268, 267, 275, 249, 254, 257, 9, 207, 209, 264, 270

(56) References Cited

U.S. PATENT DOCUMENTS

| | | | | | |
|---|---|---|---|---|---|
| 5,905,972 | A | * | 5/1999 | Huang et al. | 704/268 |
| 6,163,769 | A | * | 12/2000 | Acero et al. | 704/243 |
| 6,185,533 | B1 | * | 2/2001 | Holm et al. | 704/267 |
| 6,260,016 | B1 | * | 7/2001 | Holm et al. | 704/260 |
| 2002/0013708 | A1 | * | 1/2002 | Walker et al. | 704/260 |

OTHER PUBLICATIONS

Pearson, Steve; Kibre, Nicholas; Niedzielski, Nancy; A Synthesis Method Based on Concatenation of Demisyllables and a Residual Excited Vocal Tract Model; ICSLP; 1998; pp. 2739–2742.

Yoram, Meron; Hirose, Keikichi; Language Taining System Utilizing Speech Modification; Department of Information and Communication Engineering, University of Tokyo, Japan; 1996.

Meron, Yoram; Hirose, Keikichi; Efficient Weight Training for Selection Based Synthesis; Department of Information and Communication Engineering; University of Tokyo, Japan; Eurospeech, 1999.

Silverman, Kim; Beckman, Mary; Pitrelli, John; Ostendorf, Mari; Wightman, Colin; Price, Patti; Pierrehumbert, Janet; Hirschberg, Julia; TOBI: A Standard for Labeling English Prosody; ICSLP; 1992; pp. 867–870.

Yoram, Meron; Hirose, Keikichi; Language Training System Utilizing Speech Modification; Department of Information and Communication Engineering, University of Tokyo, Japan; ICSLP; 1996.

* cited by examiner

*Primary Examiner*—Richemond Dorvil
(74) *Attorney, Agent, or Firm*—Harness, Dickey & Pierce, PLC

(57) ABSTRACT

A speech synthesizer customization system provides a mechanism for generating a hierarchical customized user database. The customization system has a template management tool for generating the templates based on customization data from a user and associated replicated dynamic synthesis data from a text-to-speech (TTS) synthesizer. The replicated dynamic synthesis data is arranged in a dynamic data structure having hierarchical levels. The customization system further includes a user database that supplements a standard database of the synthesizer. The tool populates the user database with the templates such that the templates enable the user database to uniformly override subsequently generated speech synthesis data at all hierarchical levels of the dynamic data structure.

24 Claims, 6 Drawing Sheets

METHOD AND TOOL FOR CUSTOMIZATION OF SPEECH SYNTHESIZER DATABASES USING HIERARCHICAL GENERALIZED SPEECH TEMPLATES

BACKGROUND OF THE INVENTION

1. Technical Field

The present invention relates generally to speech synthesis. More particularly, the present invention relates to a speech synthesizer customization system that is able to override speech synthesis data at all hierarchical levels of a dynamic data structure.

2. Discussion

As the quality of the output of speech synthesizers continues to increase, more and more applications are beginning to incorporate synthesis technologies. For example, car navigation systems, as well as devices for the vision impaired are beginning to incorporate speech synthesizers. As the, popularity of speech synthesis increases, however, a number of limitations with regard to conventional approaches have become apparent.

A particular difficulty relates to the fact that size and development cost considerations limit the vocabulary with which conventional synthesizers are able to deal. Briefly, FIGS. 1 and 2 illustrate that the typical synthesizer will have a dynamic data structure with hierarchical levels, wherein the dynamic data structure includes a linguistic tree 20 and an acoustic tree 22. The linguistic tree 20 typically contains syntactic and linguistic objects for the sentence being synthesized, while the acoustic tree 22 holds prosodic and acoustic objects for that sentence. Thus, during synthesis of a sentence, the two hierarchical tree-like structures are "built up" (or populated) based on the input text. It will be appreciated that usually, a tree has nodes such that a "parent" node has "branches" to each of its "child" nodes. The linguistic tree 20 and the acoustic tree 22 are referred to as tree-like structures because, here, a parent node only has access to the first child and last child, while the rest of the children are contained in a list. Furthermore, each child has access to the corresponding parent. Nevertheless, the levels of the tree structures constitute a hierarchy.

The above tree structures and node information for a particular sentence are built up in real time by various synthesis modules, with the assistance of a fixed (or standard) database. For example, a parsing module typically generates clauses and phrases from the sentence being synthesized, while a phoneticizer uses the standard database to build up morphs and phonemes from the words in the sentence. Syllabification and allophone rules contained in the standard database generate syllables and allophones from words, morphs, and phonemes. Prosody algorithms generate prosodic phrases, prosodic words, etc. from all previous information.

As shown in FIG. 3, the standard database 24 typically therefore contains tables with information to be placed in the nodes of the trees 20, 22. This is especially true for contemporary "concatenation synthesis". It should be noted that the standard database 24 is also naturally hierarchical, since the data stored in the standard database 24 is intended to supply information for various level nodes in the dynamic trees 20, 22. Furthermore, data at higher levels of the database 24 may refer to lower level data (or vice versa). For example, information about a certain kind of phrase may refer to sequences of words and their corresponding dictionary information below. In this manner, data is shared (and memory conserved) by possible multiple references to the same data item. Roughly speaking, the standard database 24 is a relational database.

It is important to note that the above-described database 24 is designed for general unlimited synthesis, and has significant space and development cost problems. Because of these normal limitations, the size and complexity of the database 24 is typically limited. As a result, in order to tailor a given synthesizer to a particular application, it has been found that a user database is often necessary. In fact, synthesizers routinely provide "user dictionaries" which are loaded into the synthesizer and are application specific. Often, markup languages allow commands to be embedded in the input text in order to alter the synthesized speech from the standard result. For example, one approach involves inserting high and low tone marks (including numeric values), into the text to indicate where, and how much to raise an intonation peak.

While the above-described conventional approaches to user databases are useful in some circumstances, a number of difficulties remain. For example, the subsequently generated speech synthesis data cannot be uniformly overridden at all hierarchical levels of the dynamic data structure. Rather, the conventional synthesizer deals with a maximum of one or two hierarchical levels, and each with different mechanisms. Furthermore, some of the hierarchical levels (such as diphone) are essentially inaccessible to text markup due to the inability to achieve the required level of granularity in linear text.

It is also important to note that conventional user database approaches are not able to override speech synthesis data within the normal synthesis sequence of computation. Imagine, for example, that we want to specify a new user supplied diphone A-B, but only if the requested stress level on A is 2 and certain kinds of allophones are found in the surrounding context of what is to be synthesized. It will be appreciated that certain conditions are only known after a complex set of allophone rules are applied (thus determining the allophone stream) and after a prosody module has selected words to de-emphasize, which in turn affects the stress level on a given phoneme. Under conventional approaches, this conditional information cannot practically be known in advance of synthesis. It is therefore virtually impossible to automatically "markup" the input text at every place where the customized diphone should be used. Simply put, user defined conditions cannot currently be based on internal states of the synthesis process, and are therefore severely limited under the traditional text markup process.

Another concern is that conventional user databases are typically not organized around the same hierarchical levels as the dynamic data structures and therefore provide inflexible control over where and what is modified during the synthesis.

The above and other objectives are provided by a speech synthesizer customization system in accordance with the present invention. The customization system has a template management tool for generating templates based on customization data from a user and replicated dynamic synthesis data from a text-to-speech (TTS) synthesizer. The replicated dynamic synthesis data is arranged in a dynamic data structure having hierarchical levels. The customization system further includes a user database that supplements a standard database of the synthesizer. The tool populates the user database with the templates such that the templates enable the user database to uniformly override subsequently generated speech synthesis data at all hierarchical levels of the dynamic data structure. The use of a tool therefore provides a mechanism for organizing, tuning, and maintaining hierarchical and multi-dimensionally sparse sets of user templates. Furthermore, providing a mechanism for uniformly overriding speech synthesis data reduces processing overhead and provides a more "natural" user database.

Further in accordance with the present invention, a user database is provided. The user database has a plurality of templates for overriding speech synthesis data of a TTS synthesizer. The speech synthesis data is arranged in a dynamic data structure having hierarchical levels. The user database further includes a hierarchical data structure organizing the templates such that the templates enable the user database to uniformly override subsequent generated speech synthesis data at all hierarchical levels of the dynamic data structure.

In another aspect of the invention, a method for customizing a synthesizer is provided. The method includes the step of generating templates based on customization data from a user and associated replicated dynamic synthesis data from the synthesizer. A standard database of the synthesizer is supplemented with a user database. The method further provides for populating the user database with the templates such that the templates enable the user database to uniformly override subsequently generated speech synthesis data at a plurality of a hierarchical levels in the dynamic data structure.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute part of this specification. The drawings illustrate various features and embodiments of the invention, and together with the description serve to explain the principles and operation of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
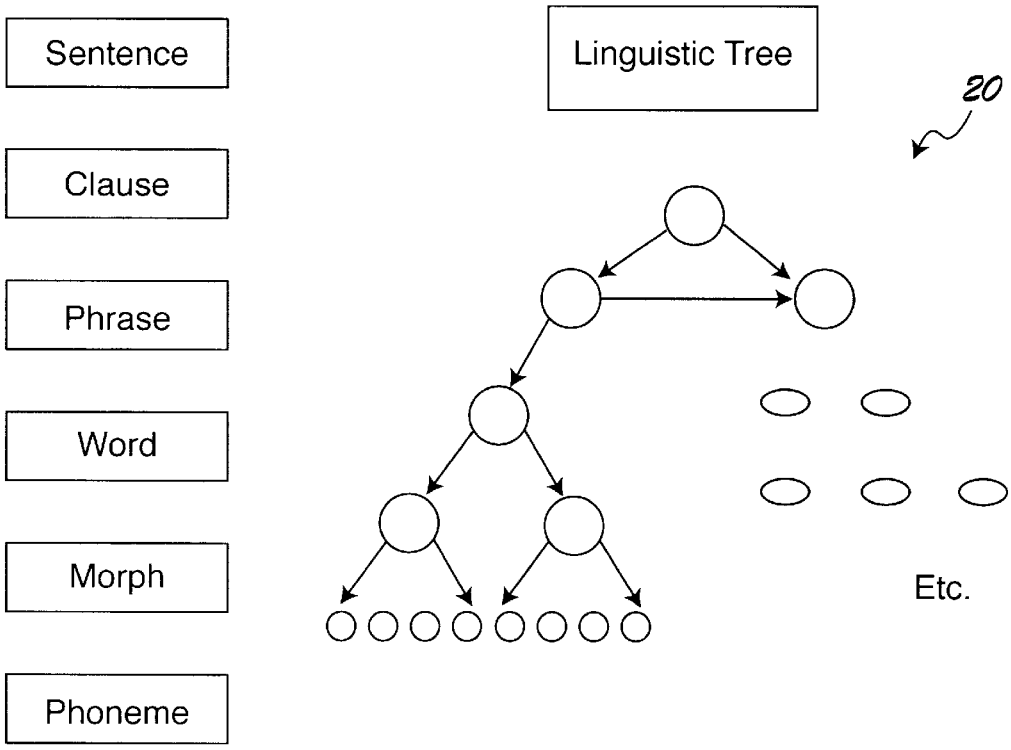
Prior Art FIG. 1
FIG. 1 is a diagram of a conventional linguistic tree structure, useful in understanding the invention.
Figure 2:
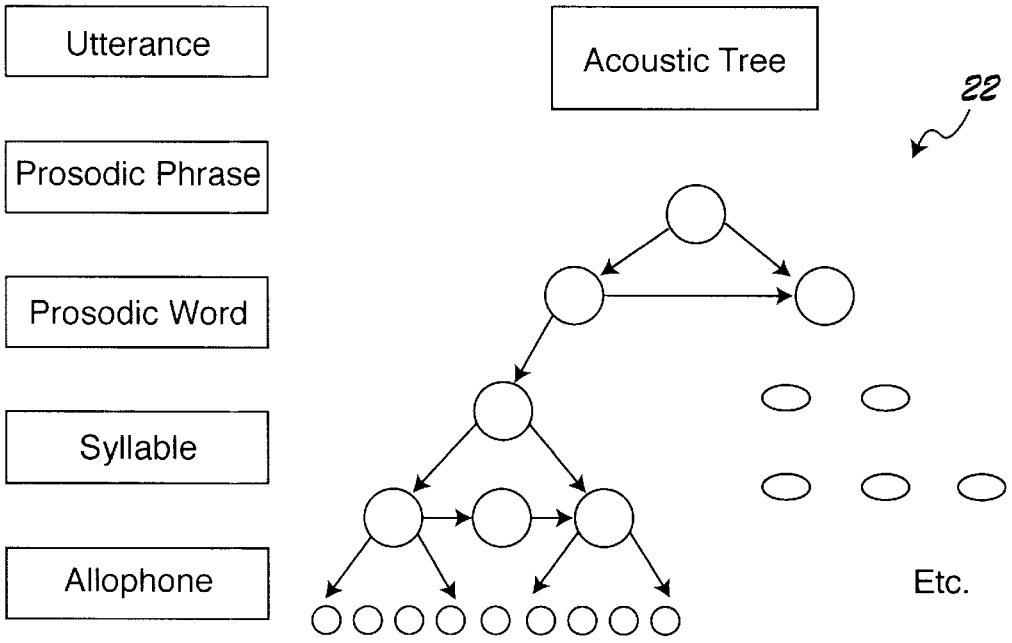
Prior Art FIG. 2
FIG. 2 is a diagram of a conventional acoustic tree structure, useful in understanding the invention.
Figure 3:
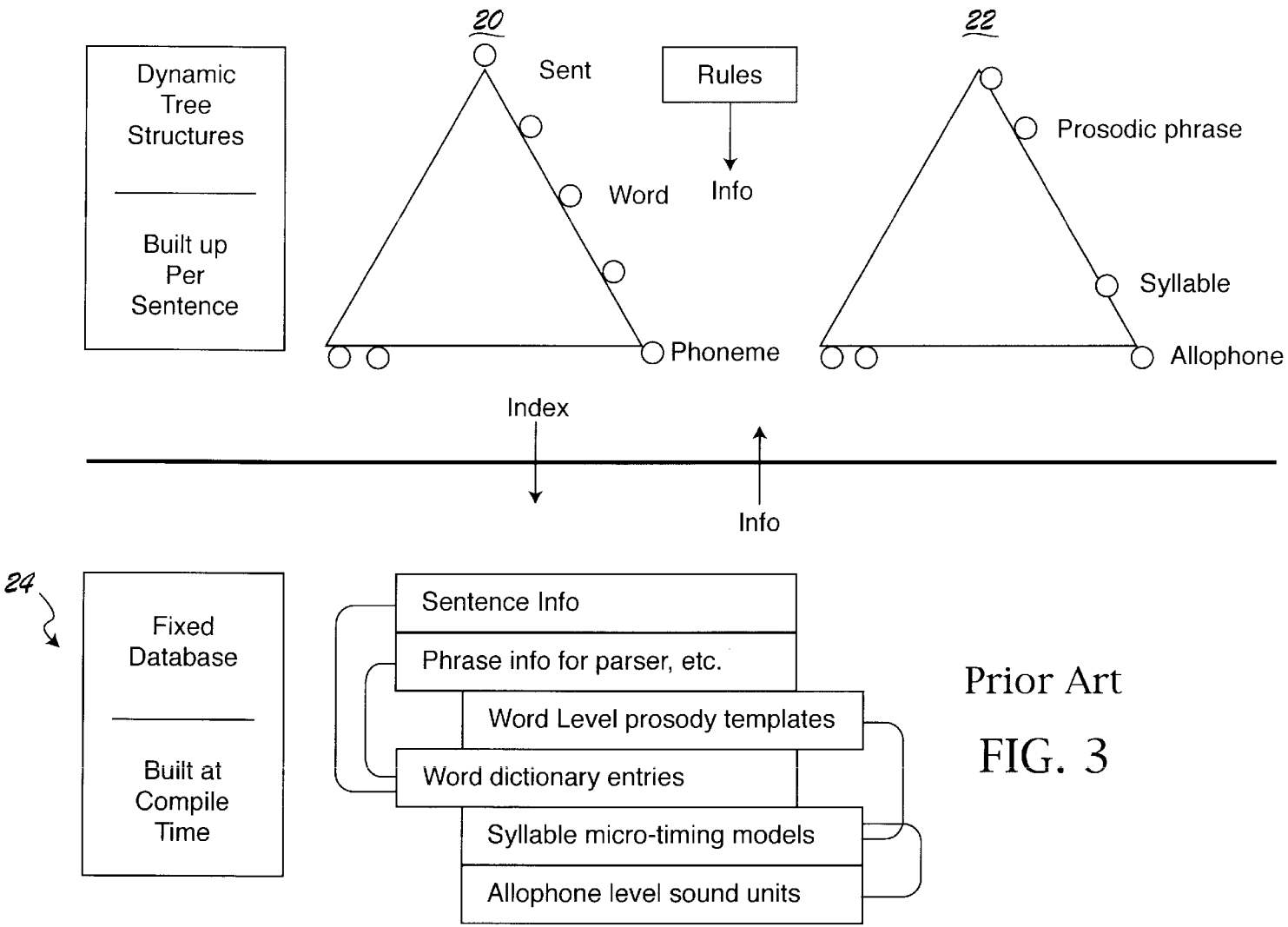
Prior Art FIG. 3
FIG. 3 is a block diagram of a conventional text-to-speech synthesizer, useful in understanding the invention.
Figure 4:
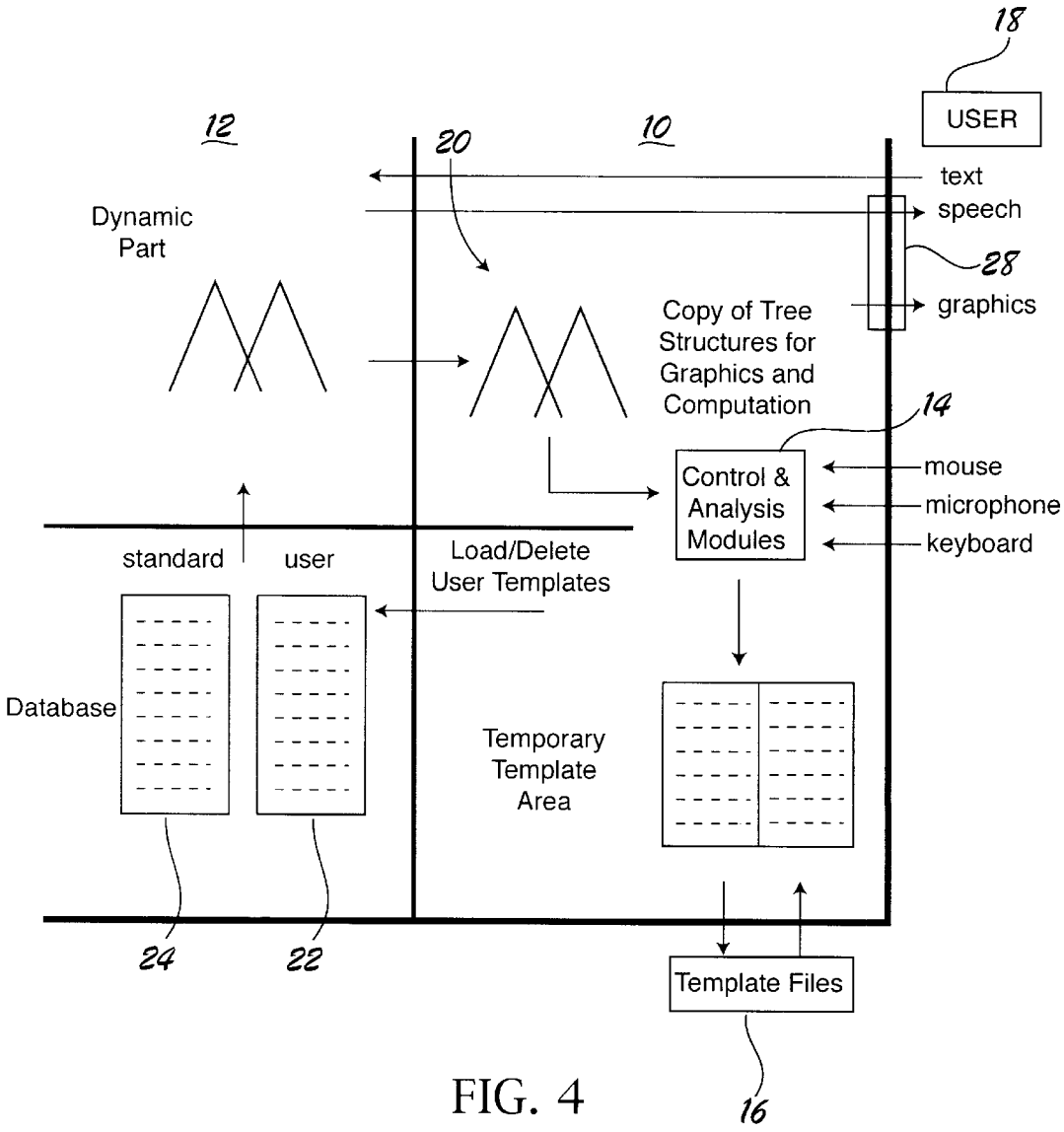
FIG. 4 is a block diagram showing a speech synthesizer customization system in accordance with the principles of the present invention.

Turning now to FIG. 4, a speech synthesizer customization system 10 is shown. It is important to note that the customization system 10 can be useful to applications such as car navigation, call routing, foreign language teaching, and synthesis of internet contents. In each of these applications, there may be a need to customize a general speech synthesizer 12 with a priori knowledge of the application environment. Thus, although the preferred embodiment will be described in reference to car navigation, the nature and scope of the invention is not so limited.

Generally, the customization system 10 has a template management tool 14 for generating templates based on customization data from a user 18 and replicated dynamic synthesis data 20 from a text-to-speech (TTS) synthesizer 12. As already discussed, the replicated dynamic synthesis data 20 is arranged in a dynamic data structure having hierarchical levels. The customization system 10 further includes a user database 22 supplementing a standard database 24 of the synthesizer 12. As will be discussed in greater detail below, the tool 10 populates the user database 22 with the templates 16 such that the templates 16 enable the user database 22 to uniformly override subsequently generated speech synthesis data at all hierarchical levels of the dynamic data structure.

Figure 6:
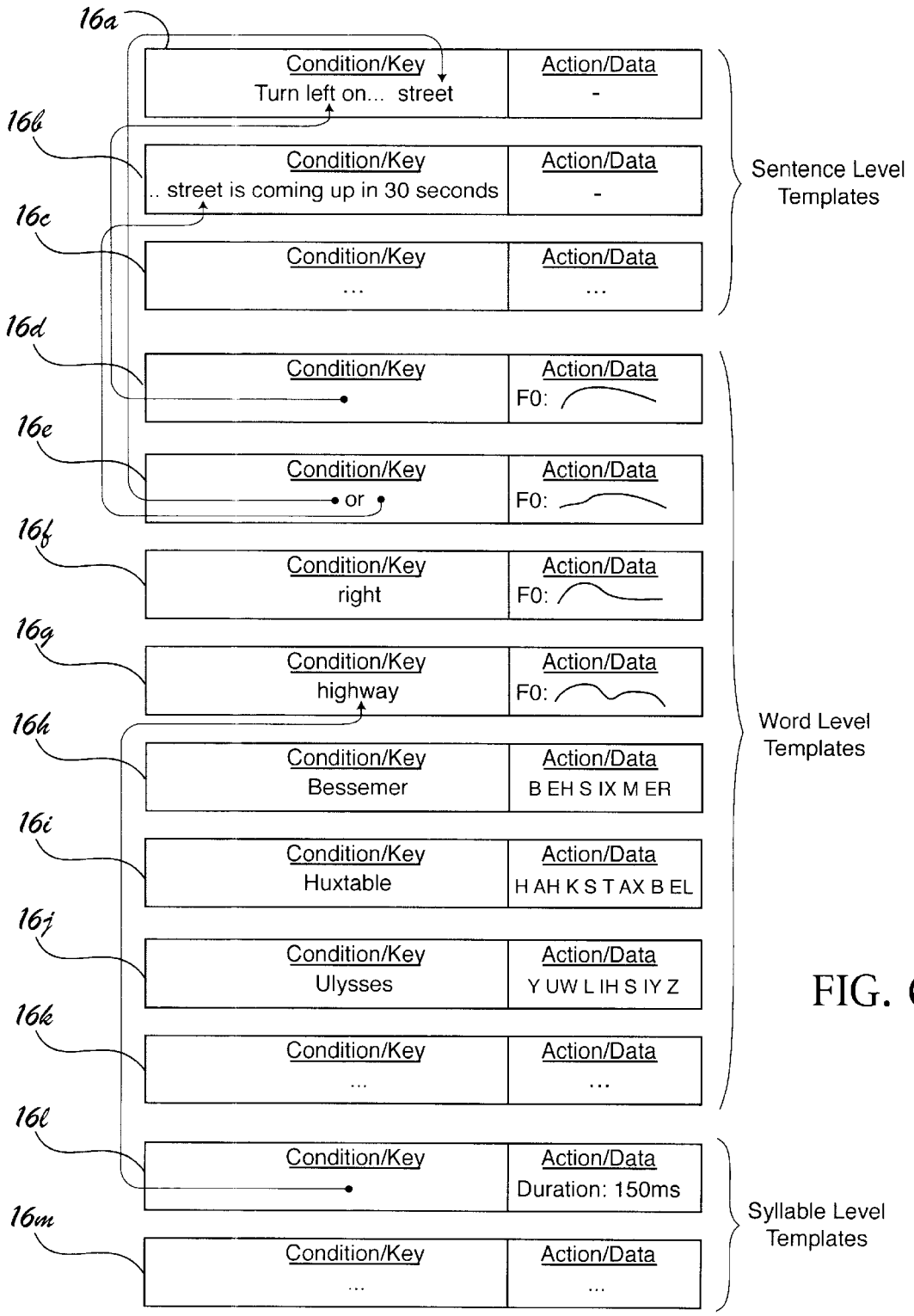
FIG. 6 is a diagram of a user database according to one embodiment of the present invention.

FIG. 6 illustrates that each template 16 defines a condition/key under which the template 16 is used to override the speech synthesis data and an action/data to be executed in order to override the speech synthesis data. It will be appreciated that the condition can generally correspond to a hierarchical level of either a linguistic tree structure or an acoustic tree structure. Thus, templates 16*a*–16*c* correspond to a sentence level of a linguistic tree structure. It can be seen that the top level templates can be used to match a frame sentence, wherein matching frame sentences at the top level reduces run-time processing requirements at the lower levels. For example, the condition for template 16a is matched to the lower level template 16d and therefore only needs to be satisfied once to trigger the corresponding actions of both templates 16a and 16*d*.

It can further be seen that templates 16*d*–16*k* have conditions that generally correspond to a word level of a linguistic tree structure. It can be seen that lower-level templates 16*d*–16*g* are used to customize fundamental frequency contours, and that template 16*e* is additionally matched to top level templates 16*a* and 16*b* to reduce storage requirements. It will further be appreciated that simple "non-matched" templates such as template 16*f* and 16*h* can be used for more local customization.

Furthermore, an example of conditions corresponding to a syllable level of an acoustic tree structure are shown in templates 16*l* and 16*m*. It is important to note that matching can occur across tree structures. Thus, syllable level template 16*l* (of the acoustic tree structure) can be matched to word level template 16*g* (of the linguistic tree structure) in order to further conserve processing resources. FIG. 6 therefore illustrates that the templates 16 can be used to customize a variety of parameters. While the illustrated user database 22 is merely a snapshot of a typical database, it provides a useful illustration of the benefits associated with the present invention.

Figure 5:
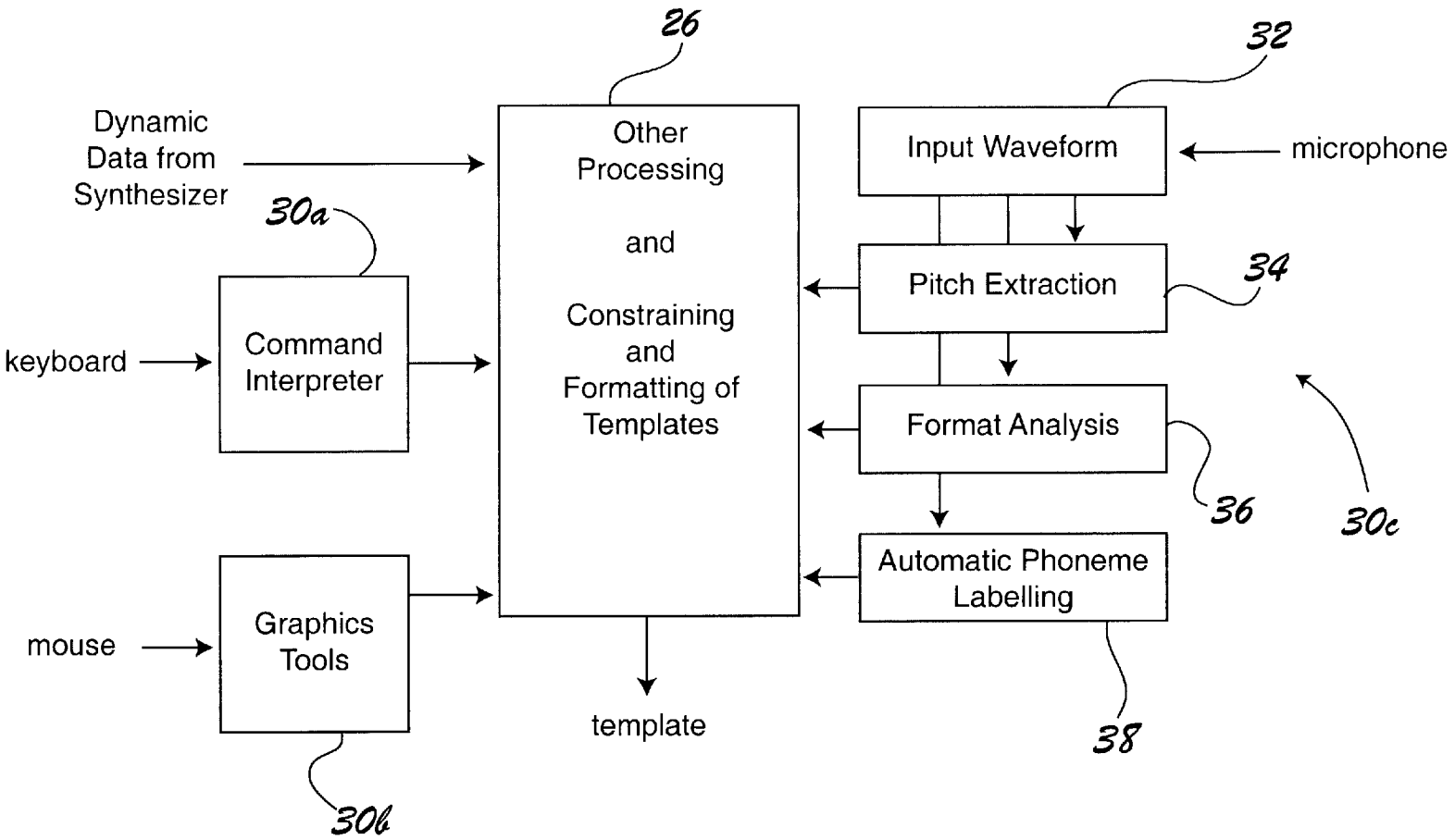
FIG. 5 is a block diagram of a template management tool according to one embodiment of the present invention.

With continuing reference to FIGS. 4 and 5, the preferred template management tool 10 will be discussed in greater detail. It can be seen that generally the tool 10 includes a template generator 26, an output interface 28, and one or more input interfaces 30. The template generator 26 processes the replicated dynamic synthesis data 20 based on the customization data, and the output interface 28 graphically displays the replicated dynamic synthesis data 20 (and any other desirable data) to the user 18. The input interfaces 30 obtain the customization data from the user 18.

It is important to note that the method described herein for customizing the TTS synthesizer 12 is an iterative one. Thus, the arrows transitioning between the four regions shown in FIG. 4 can be viewed as part of a cyclical process in which templates are generated and the supplemental user database is populated repeatedly until a desired synthesizer output is obtained. It will be appreciated that the desired synthesizer output is largely dictated by the application for which the customization system is used (i.e., car navigation, vision impaired devices, etc.).

It is preferred that the input interfaces include a command interpreter 30*a* operatively coupled between a keyboard device input and the template generator 26. A graphics tool module 30*b* is operatively coupled between a mouse device input and the template generator 26. A sound processing module 30*c* is operatively coupled between a microphone device input and the template generator 26. In one embodiment, the sound processing module 30*c* includes an input wave form submodule 32 for generating an input wave form based on data obtained from the microphone device input. A pitch extraction module 34 generates pitch data based on the input waveform, while a formant analysis submodule 36 generates formant data based on the input waveform. It is further preferred that a phoneme labeling submodule 38 automatically labels phonemes based on the input waveform.

Those skilled in the art can now appreciate from the foregoing description that the broad teachings of the present invention can be implemented in a variety of forms. Therefore, while this invention can be described in connection with particular examples thereof, the true scope of the invention should not be so limited since other modifications will become apparent to the skilled practitioner upon a study of the drawings, specification and following claims.

What is claimed is:

1. A speech synthesizer customization system comprising:

a template management tool for generating templates based on customization data from a user and replicated dynamic synthesis data from a text-to-speech synthesizer, the replicated dynamic synthesis data being arranged in a dynamic data structure having hierarchical levels, wherein each template defines a condition under which the template is used to override the speech synthesis data;

a user database supplementing a standard database of the synthesizer;

said tool populating the user database with the templates such that the templates enable the user database to uniformly override subsequently generated speech synthesis data at all hierarchical levels of the dynamic data structure.

2. The customization system of claim 1 wherein each template defines an action to be executed in order to override the speech synthesis data.

3. The customization system of claim 1 wherein the condition corresponds to a hierarchical level of a linguistic tree structure.

4. The customization system of claim 1 wherein the condition corresponds to a hierarchical level of an acoustic tree structure.

5. The customization system of claim 1 wherein the tool includes:

a template generator for processing the replicated dynamic synthesis data based on the customization data;

an output interface for graphically displaying the replicated dynamic synthesis data to the user; and one or more input interfaces for obtaining the customization data from the user.

6. The customization system of claim 5 wherein the input interfaces include a command interpreter operatively coupled between a keyboard device input and the template generator.

7. The customization system of claim 5 wherein the input interfaces include a graphics tools module operatively coupled between a mouse device input and the template generator.

8. The customization system of claim 5 wherein the input interfaces include a sound processing module operatively coupled between a microphone device input and the template generator.

9. The customization system of claim 8 wherein the sound processing module includes:

an input waveform submodule for generating an input waveform based on data obtained from the microphone device input;

a pitch extraction submodule for generating pitch data based on the input waveform;

a formant analysis submodule for generating formant data based on the input waveform; and a phoneme labeling submodule for automatically labeling phonemes based on the input waveform.

10. A user database comprising:

a plurality of templates for overriding speech synthesis data of a text-to-speech synthesizer, wherein each template defines a condition under which the template is used to override the speech synthesis data;

said speech synthesis data being arranged in a dynamic data structure having hierarchical levels; and a hierarchical data structure organizing the templates such that the templates enable the user database to uniformly override subsequently generated speech synthesis data at all hierarchical levels of the dynamic data structure.

11. The user database of claim 10 wherein each template defines a condition under which the template is used to override the speech synthesis data and an action to be executed in order to override data.

12. The user database of claim 10 wherein the condition corresponds to a sentence level of a linguistic tree structure.

13. The user database of claim 10 wherein the condition corresponds to a clause level of a linguistic tree structure.

14. The user database of claim 10 wherein the condition corresponds to a phrase level of a linguistic tree structure.

15. The user database of claim 10 wherein the condition corresponds to a word level of a linguistic tree structure.

16. The user database of claim 10 wherein the condition corresponds to a morpheme level of a linguistic tree structure.

17. The user database of claim 10 wherein the condition corresponds to a phoneme level of a linguistic tree structure.

18. The user database of claim 10 wherein the condition corresponds to an utterance level of an acoustic tree structure.

19. The user database of claim 10 wherein the condition corresponds to a prosodic phrase level of an acoustic tree structure.

20. The user database of claim 10 wherein the condition corresponds to a prosodic word level of an acoustic tree structure.

21. The user database of claim 10 wherein the condition corresponds to a syllable level of an acoustic tree structure.

22. The user database of claim 10 wherein the condition corresponds to an allophone level of an acoustic tree structure.

23. A method for customizing a text-to-speech synthesizer, the method comprising the steps of:

(a) generating templates based on customization data from a user and replicated dynamic synthesis data from the synthesizer, wherein each template defines a condition under which the template is used to override the dynamic synthesis data and an action to be executed in order to override data;

(b) supplementing a standard database of the synthesizer with a user database; and (c) populating the user database with the templates such that the templates enable the user database to uniformly override subsequently generated speech synthesis data at a plurality of hierarchical levels of the dynamic data structure.

24. The method of claim 23 further including the step of iteratively repeating steps (a) through (c) until a desired synthesizer output is obtained.

* * * * *